US010292517B1

(12) United States Patent
Lawver

(10) Patent No.: US 10,292,517 B1
(45) Date of Patent: May 21, 2019

(54) DRESSING AID

(71) Applicant: Lindsey Janae Lawver, Joplin, MO (US)

(72) Inventor: Lindsey Janae Lawver, Joplin, MO (US)

( * ) Notice: Subject to any disclaimer, the term of this patent is extended or adjusted under 35 U.S.C. 154(b) by 0 days.

(21) Appl. No.: 16/132,613

(22) Filed: Sep. 17, 2018

(51) Int. Cl.
*A47G 25/90* (2006.01)
*A41F 3/02* (2006.01)
*A41D 1/06* (2006.01)

(52) U.S. Cl.
CPC ..... *A47G 25/90* (2013.01); *A41F 3/02* (2013.01); *A41D 1/06* (2013.01)

(58) Field of Classification Search
CPC ..... A47G 25/00; A47G 25/90; A41F 3/02; A41F 9/00; A41D 1/06
See application file for complete search history.

(56) References Cited

U.S. PATENT DOCUMENTS 2,047,810 A * 7/1936 Wagner ..... A41F 3/02 24/600.9
5,884,371 A 3/1999 Huggins
7,988,022 B1 * 8/2011 Hansson ..... A47G 25/905 223/111
8,091,748 B2 1/2012 Whitlaw
9,414,705 B2 8/2016 Sclafani
9,936,832 B2 4/2018 McBroom et al.
2005/0205619 A1 9/2005 Morel
2010/0006609 A1 * 1/2010 McAllister ..... A47G 25/905 223/111
2010/0078450 A1 4/2010 Longhurst
2010/0258600 A1 10/2010 Pfistor et al.
2011/0315724 A1 12/2011 Whitlaw
2016/0022078 A1 * 1/2016 Sclafani ..... A41F 11/16 2/315

* cited by examiner

*Primary Examiner* — Ismael Izaguirre
(74) *Attorney, Agent, or Firm* — Shane Cortesi

(57) ABSTRACT

A dressing aid is described. The dressing aid may include a main arm having a proximal end and a distal end, at least one (preferably at least two) proximal arm extending from the main arm proximal end, the proximal arm(s) having a distal end attached to the main arm proximal end and a proximal end attached to a proximal clip, and at least one (preferably at least two) distal arm extending from the main arm distal end, the distal arm(s) having a proximal end attached to the main arm distal end and a distal end attached to a distal clip. The proximal and distal arms may further comprise a hook. The proximal, distal and main arms are preferably formed of gooseneck tubing or another type of bendable but rigid tubular material.

17 Claims, 7 Drawing Sheets

DRESSING AID

BACKGROUND

Technical Field

The present invention relates to dressing aids.

Background of the Invention

Elderly and other users with limited mobility have difficulty putting on pants and other clothing items.

A number of devices have been developed to assist the users.

For example, dressing sticks are used for assisting users in taking off socks. In addition, reachers, sock aids, and claws are used to help users pull on socks, shoes and pants.

U.S. Pat. No. 5,884,371 (the '371 Patent) teaches a dressing aid in the form of a band with two chip clips at the ends. The band is preferably in the form of a cord, which may be comprised of any conventional material that is durable and flexible such as cloth, leather, plastic and elastic materials. Preferably, the band is 70% nylon and 30% polypropylene. The Sammons Pant Clip (Sammons Preston), available on Amazon, is similar to the device disclosed in the '371 Patent.

However, the lack of rigidity in the device could be problematic for users with limited mobility.

Therefore, there is a need for new dressing aids that are easy to use for users with limited mobility.

BRIEF SUMMARY

The present disclosure provides dressing aids as described herein. In some embodiments, the present disclosure provides a dressing aid comprising: a main arm having a proximal end and a distal end; at least two proximal arms extending from the main arm proximal end, each of the at least two proximal arms having a distal end attached to the main arm proximal end and a proximal end attached to a proximal clip; and at least two distal arms extending from the main arm distal end, each of the at least two distal arms having a proximal end attached to the main arm distal end and a distal end attached to a distal clip. Optionally, the main arm, the at least two proximal arms and the at least two distal arms are bendable, rigid and not elastic. Optionally, the at least two proximal arms and the at least two distal arms are metallic. Optionally, the at least two proximal arms and the at least two distal arms are formed of gooseneck tubing or another type of flexible but rigid and not elastic type of tubular material. Optionally, each proximal arm and each distal arm comprises a hook. Optionally, each hook of the proximal arm comprises a lower end attached to the proximal arm and a free upper end and further wherein each hook of the distal arm comprises a lower end attached to the distal arm and a free upper end. Optionally, the hooks are L-shaped. Optionally, each hook is comprised of an elastic material. Optionally, each proximal arm comprises a proximal arm interior surface facing the other respective proximal arm and a proximal arm exterior surface opposite the interior surface, wherein each distal arm comprises a distal arm interior surface facing the other respective distal arm and a distal arm exterior surface opposite the interior surface and further wherein the hooks of the proximal arms are attached to the exterior surface of the proximal arms and the hooks of the distal arms are attached to the exterior surface of the distal arms. Optionally, the main arm is in the shape of a bent cylinder. Optionally, the proximal arms and the distal arms are in the shape of a bent cylinder, the main arm comprises a diameter, and the proximal arm and distal arms have a smaller diameter as compared to the main arm diameter. Optionally, the clips are alligator clips. Optionally, the proximal arms and the distal arms are approximately the same length and shorter than the main arm.

In still further embodiments, the present disclosure provides a method of donning a garment providing the steps of: a) providing the dressing aid; b) providing a garment; c) attaching the clips to the garment; and d) grasping the main arm and moving the garment over a user. Optionally, each proximal arm and each distal arm is bent in multiple directions. Optionally, the main arm is U-shaped. Optionally, the garment is a leg garment. Optionally, at least one of the proximal arms and at least one of the distal arms comprises a hook and method further comprises draping the garment over the clip.

BRIEF DESCRIPTION OF THE DRAWINGS

in FIG. 7, the main arm and proximal and distal arms are formed of gooseneck tubing.

DETAILED DESCRIPTION

Figure 1:
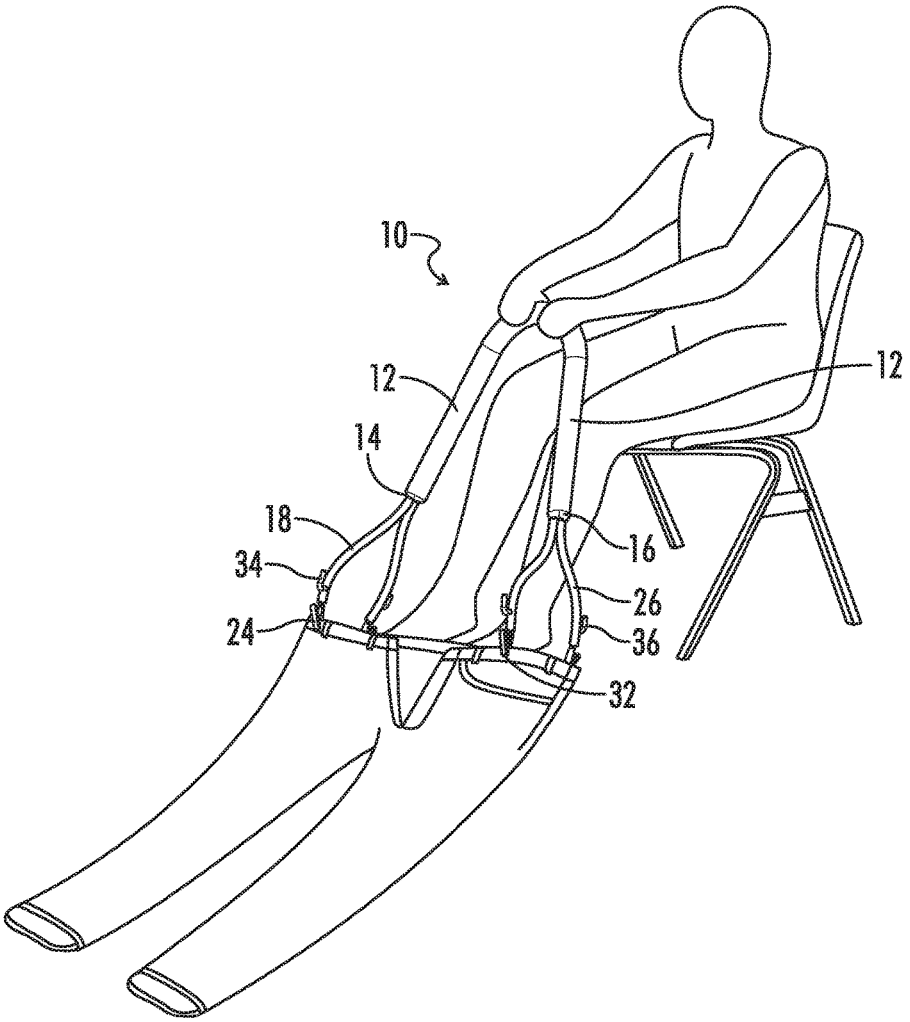
FIG. 1 illustrates a front perspective view of a person using a dressing aid of one embodiment of the present invention.
Figure 2:
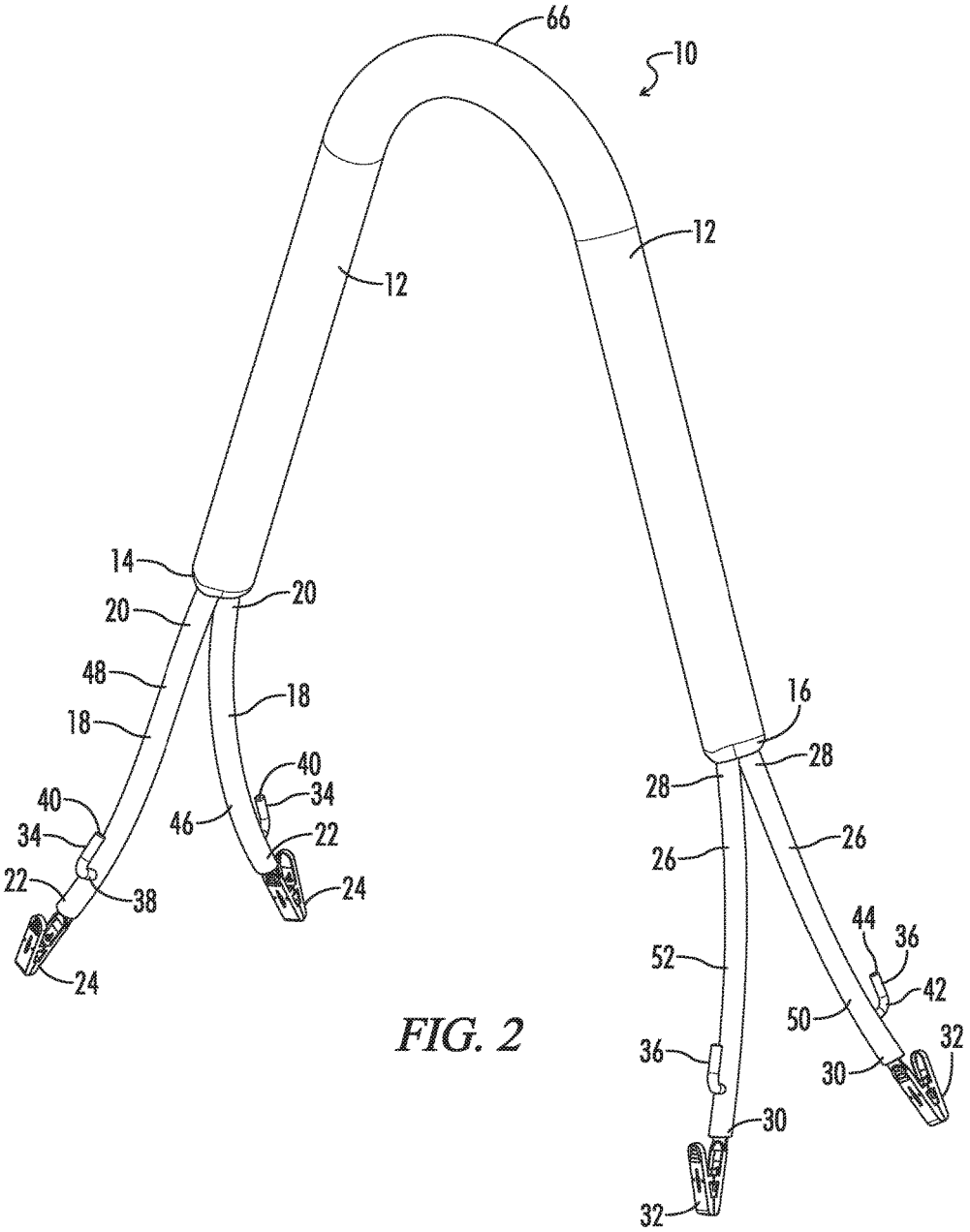
FIG. 2 illustrates a front perspective view of the dressing aid of FIG. 1 with the proximal and distal arms in another orientation.
Figure 3:
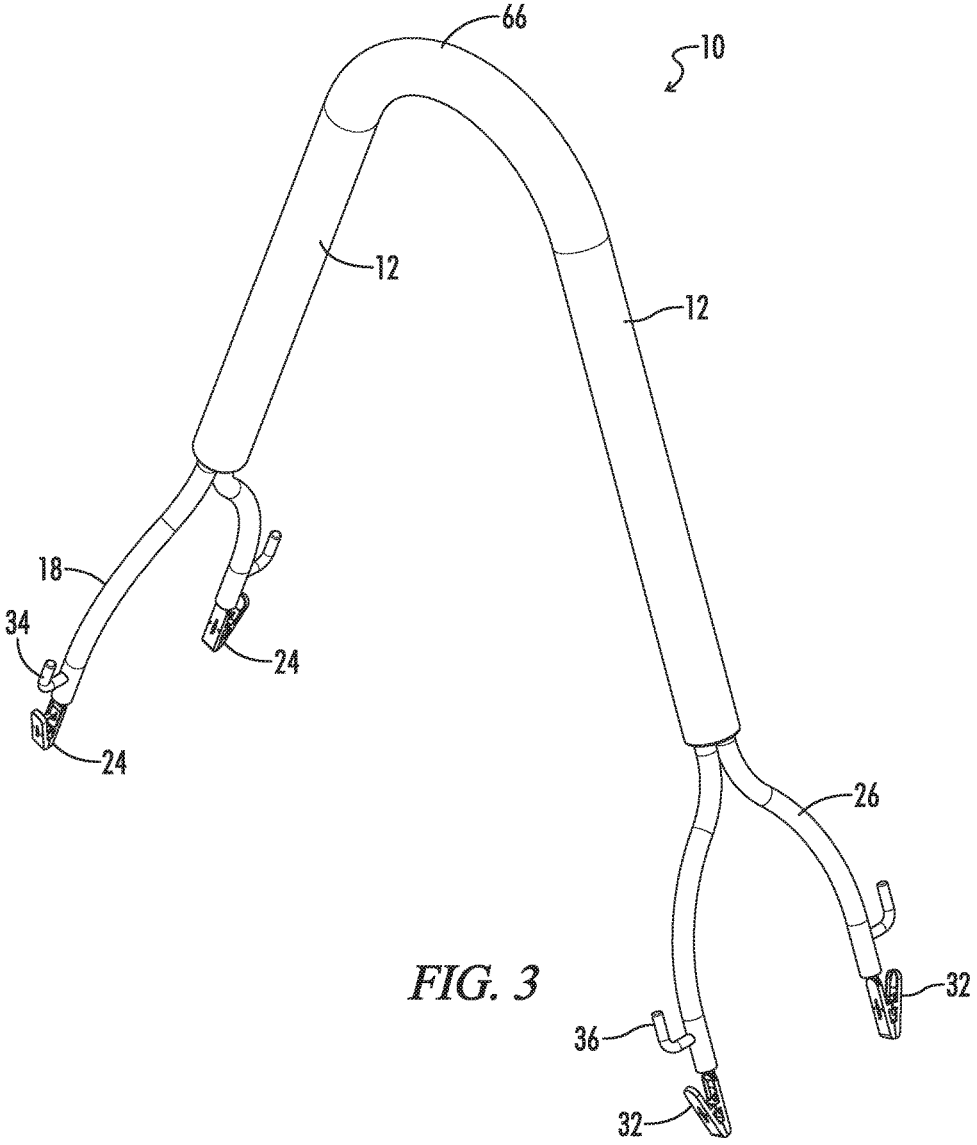
FIG. 3 illustrates a front perspective view of the dressing aid of FIG. 2 with the proximal and distal arms in another orientation.
Figure 4:
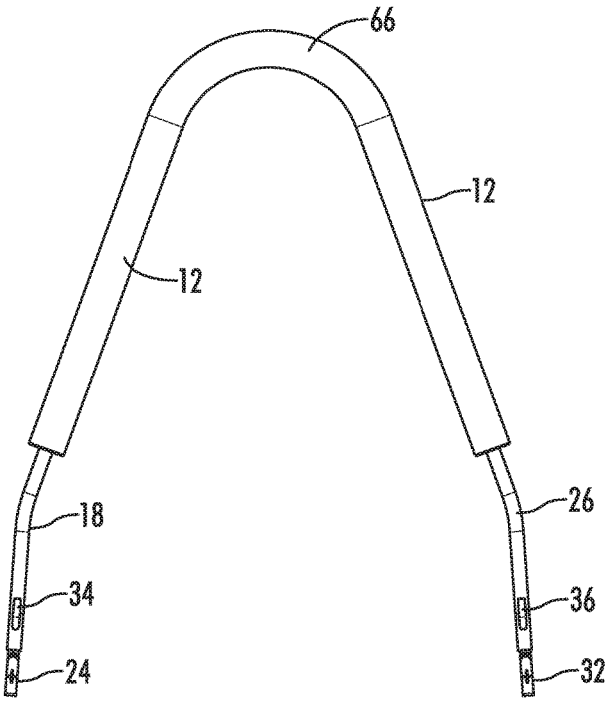
FIG. 4 illustrates a front elevation view of the dressing aid of FIG. 3.
Figure 5:
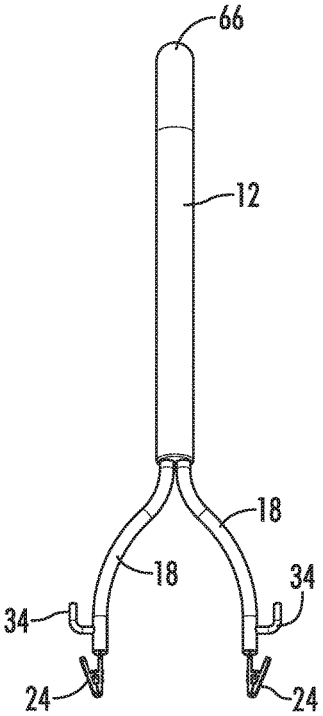
FIG. 5 illustrates a side elevation view of the dressing aid of FIG. 4.
Figure 6:
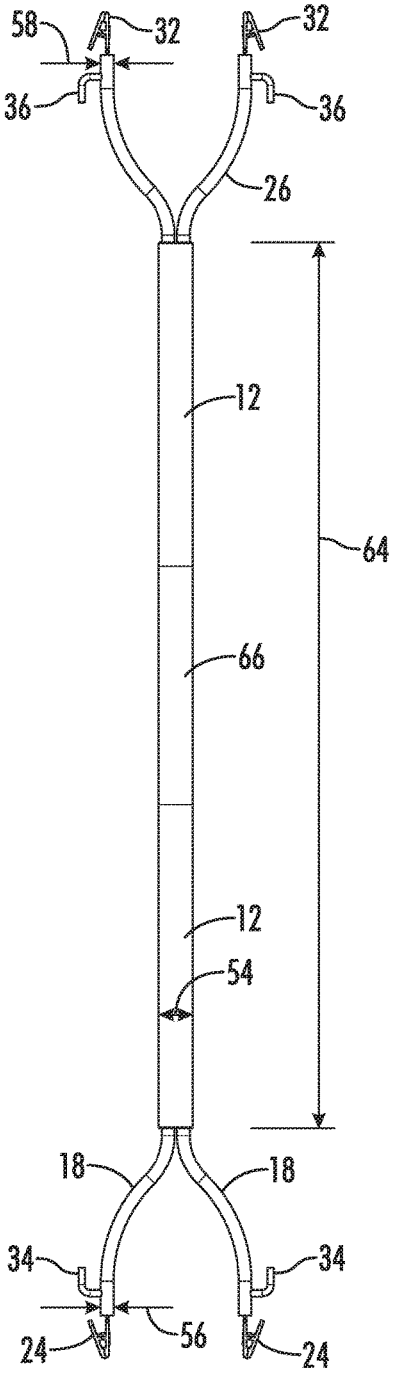
FIG. 6 illustrates a top plan view of the dressing aid of FIG. 5 with the main arm in another orientation.
Figure 7:
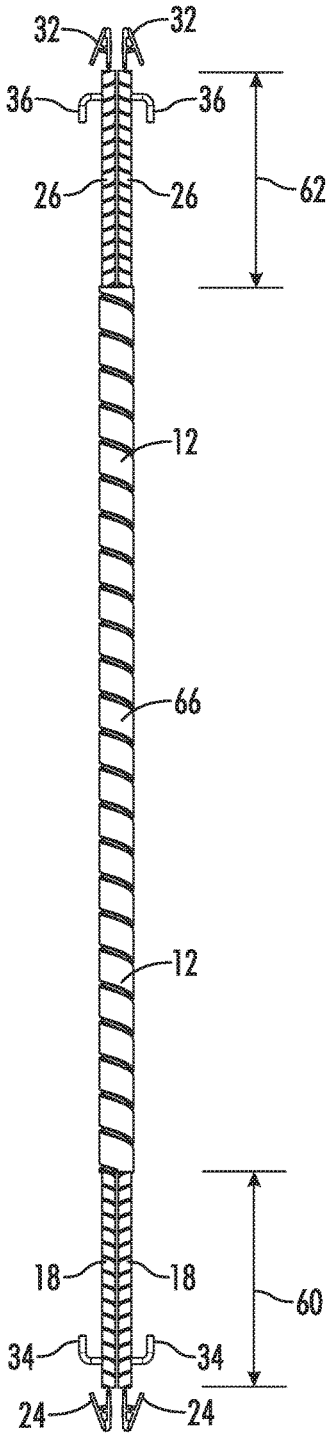
FIG. 7 illustrates a top plan view of the dressing aid of FIG. 6 with the proximal and distal arms in another orientation.
Figure 8:
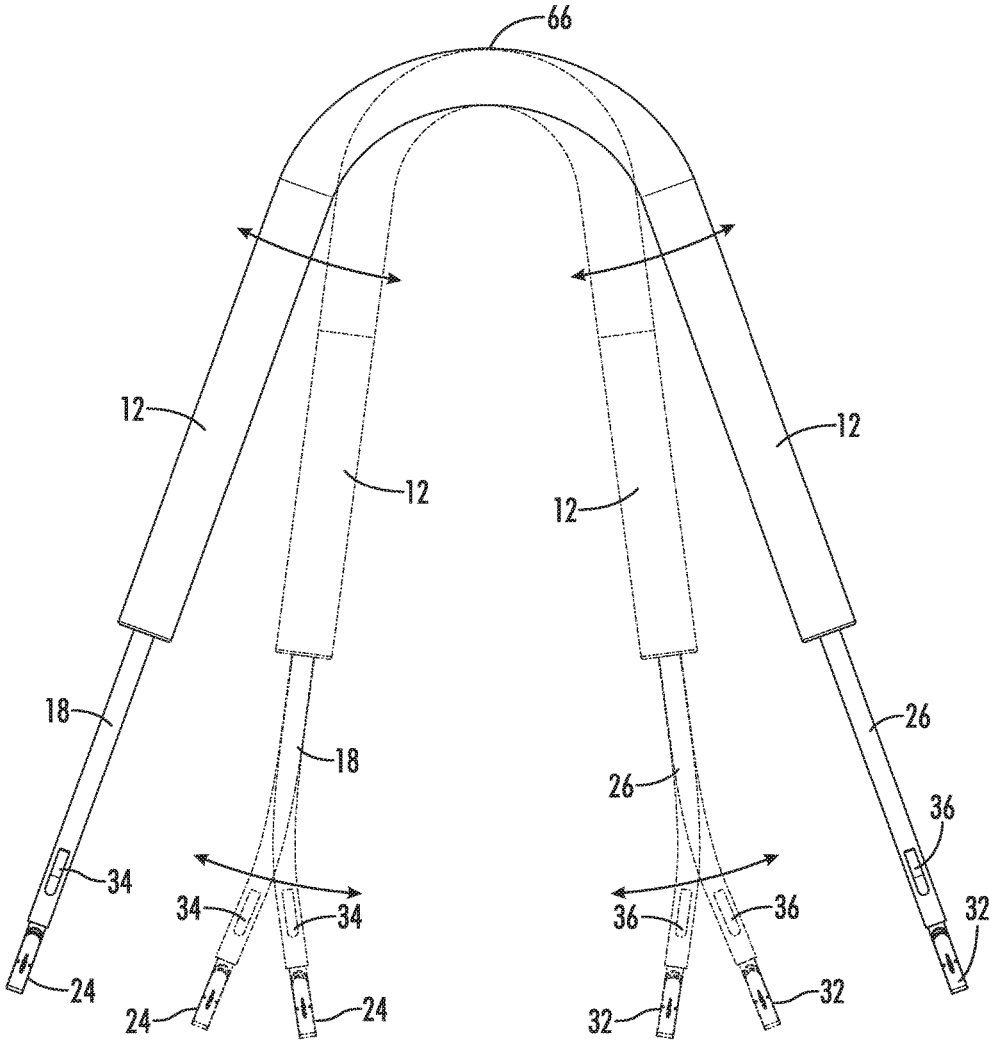
FIG. 8 illustrates a front elevation view of the dressing aid of FIG. 7 with the arrows showing various orientations of the main arm and proximal and distal arms.

With reference to FIGS. 1-9 the present invention provides a dressing aid, designated by the numeral 10. In the drawings, not all reference numbers are included in each drawing for the sake of clarity. In addition, although other dimensions are possible, FIGS. 1-9 are CAD drawings, drawn to scale.

Referring to FIGS. 1-9, the present disclosure provides a dressing aid 10 that may include a main arm 12 having a proximal end 14 and a distal end 16. The dressing aid 10 may further include at least one (preferably at least two) proximal arm(s) 18 extending from the main arm proximal end 14, the proximal arm(s) 18 having a distal end 20 attached to the main arm proximal end 14 and a proximal end 22 attached to a proximal clip 24. The dressing aid 10 may further include at least one (preferably at least two) distal arm(s) 26 extending from the main arm distal end 16, the distal arm(s) 26 having a proximal end 28 attached to the main arm distal end 16 and a distal end 30 attached to a distal clip 32. Preferably, the main arm 12, the proximal arm(s) 18 and the distal arm(s) 26 are bendable/flexible by the user yet rigid in supporting the garment and not elastic. In other words, the main arm 12, the proximal arm(s) 18 and the distal arm(s) 26 are bendable by a user but retain their shape once bent and used by the individual to place a garment on himself/herself (until re-bent by the user). In some embodiments, the main arm 12, the proximal arm(s) 18 and/or the distal arm(s) 26 are formed of gooseneck tubing or another type of bendable/flexible but rigid tubing. Gooseneck tubing, also known as stayput or obedient tubing, is known in the art and used in for example desk lamps and shower heads. An example of such tubing is the snakeclamp available at snakeclamp.com (Christianburg Va.). As explained at snakeclamp.com, the inside of the gooseneck may be a spring which is made of a high-strength steel (stainless steel can also be used if the gooseneck will be exposed to moisture). This is what gives the gooseneck it's strength and flexibility. Then a soft galvanized iron wire is compressed into the gaps of the spring coil (stainless steel or brass can also be used). In addition to being made of a metallic material, gooseneck tubing may also be plastic. However, due to the increased strength, preferably the gooseneck tubing is metallic. Gooseneck tubing is only shown in FIG. 7 due to the complexity of drawing the spirals when the main arm 12, proximal arms 18, and distal arms 26 are bent.

As used herein, the word "attached" includes discretely joined separate parts as well as integral parts. Preferably, the proximal arms 18 and distal arms 26 are separate parts from the main arm 12.

Instead of two proximal arms 18 and two distal arms 26, as shown in the drawings, the dressing aid 10 may simply comprise a main arm 12 having a proximal end 14 connected to a proximal clip 24 and a distal end 16 connected to a distal clip 32, and the dressing aid 10 may be comprised of gooseneck tubing or other bendable but rigid and non-elastic materials. However, at least two proximal arms 18 and at least two distal arms 26 connected to a main arm 12 is preferred.

Figure 9:
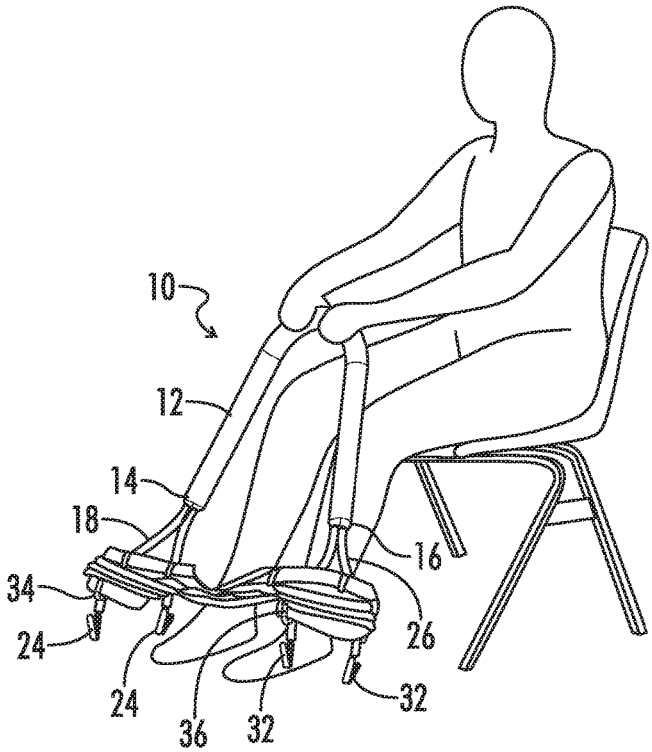
FIG. 9 illustrates a front perspective view of a person using the dressing aid of FIG. 8.

Optionally, each proximal arm 18 and each distal arm 26 comprises a hook 34,36, as illustrated in the figures. Optionally, each hook 34 of the proximal arm 18 comprises a lower end 38 attached to the proximal arm 18 and a free upper end 40 (that preferably points upwards) and each hook 36 of the distal arm 26 comprises a lower end 42 attached to the distal arm 26 and a free upper end 44 (that preferably points upwards). Optionally, the hooks are L-shaped. Optionally, though the proximal arms 18 and distal arms 26 are preferably not elastic, the hooks 34,36 attached to the proximal arms 18 and distal arms 26 may be comprised of an elastic material. Optionally, each proximal arm 18 comprises a proximal arm interior surface 46 facing the other respective proximal arm 18 and a proximal arm exterior surface 48 opposite the interior surface 46, each distal arm 26 comprises a distal arm interior surface 50 facing the other respective distal arm 26 and a distal arm exterior surface 52 opposite the interior surface 50 and the hooks 34 of the proximal arms 18 are attached to the exterior surface 48 of the proximal arms 18 and the hooks 36 of the distal arms 26 are attached to the exterior surface 52 of the distal arms 26. The hook(s) 34,36, for example, may allow the user to secure the bottom of the pants to the hook(s) 34,36 as best seen in FIG. 9, thus enabling the user to thread bilateral lower extremities through the waist opening rather than through the length of each pant leg.

Optionally, the main arm 12 is in the shape of a bent cylinder comprising a main arm diameter 54. Optionally, the proximal arms 18 and the distal arms 26 are also in the shape of a bent cylinder, and the proximal arm 18 and distal arms 26 have a smaller diameter 56,58 as compared to the main arm diameter 54. Optionally, the clips 24 and 32 are alligator clips.

Optionally, the proximal arms 18 and the distal arms 26 are approximately the same length and shorter than the main arm 12. For example, the main arm 12 may be for example 45 inches in length and the proximal and distal arms 18,26 may each be 12 inches in length. However, it will be understood that such lengths are exemplary. Optionally, the dressing aid 10 is symmetrical with the proximal arm 18 and distal arm 26 approximately equidistant from the center 66 of the main arm length 64.

The dressing aid 10 may be used in a method that includes a) providing the dressing aid 10; b) providing a garment; c) attaching the clips 24,32 to the garment; and d) grasping the main arm 12 and moving the garment over a user. For example, if the garment is a leg garment such as a pair of pants the user may pull the leg garment upwardly, as shown in FIGS. 1 and 9. Optionally, each proximal arm 18 and distal arm 26 is bent in multiple directions, as best seen in FIGS. 1, 3, 5, and 6. Optionally, the main arm 12 is U-shaped as best seen in FIGS. 1-4 8 and 9. Optionally, the method further comprises draping the garment over the hooks 34,36, as best seen in FIG. 9. In addition to a pair of pants, the dressing aid 10 may be used with other garments such as socks or shirts.

PART LIST

| | |
|---|---|
| Dressing aid | 10 |
| Main arm | 12 |
| Main arm proximal end | 14 |
| Main arm distal end | 16 |
| Proximal arms | 18 |
| Proximal arm distal end | 20 |
| Proximal arm proximal end | 22 |
| Proximal clip | 24 |
| Distal arm | 26 |
| Distal arm proximal end | 28 |
| Distal arm distal end | 30 |
| Distal clip | 32 |
| Proximal hook | 34 |
| Distal hook | 36 |
| Proximal hook lower end | 38 |
| Proximal hook upper end | 40 |
| Distal hook lower end | 42 |
| Distal hook upper end | 44 |
| Proximal arm interior surface | 46 |
| Proximal arm exterior surface | 48 |
| Distal arm interior surface | 50 |
| Distal arm exterior surface | 52 |
| Main arm diameter | 54 |
| Proximal arm diameters | 56 |
| Distal arm diameters | 58 |
| Proximal arm length | 60 |
| Distal arm length | 62 |
| Main arm length | 64 |
| Main arm center | 66 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously. It is understood that use of the singular embraces the plural and vice versa.

What is claimed is:

1. A dressing aid comprising:

a main arm having a proximal end and a distal end; and at least two proximal arms extending from the main arm proximal end, each of the at least two proximal arms having a distal end attached to the main arm proximal end and a proximal end attached to a proximal clip;

at least two distal arms extending from the main arm distal end, each of the at least two distal arms having a proximal end attached to the main arm distal end and a distal end attached to a distal clip, wherein the main arm, the at least two proximal arms and the at least two distal arms are bendable, rigid and not elastic and are comprised of gooseneck tubing comprising a spring coil, wherein each proximal arm comprises a proximal hook having a proximal end attached to the respective proximal arm and a free distal end extending away from the respective proximal clip, each proximal hook spaced apart from, and located distal to, the proximal clip attached to the respective proximal arm, and further wherein each distal arm comprises a distal hook having a distal end attached to the respective distal arm and a free proximal end extending away from the respective distal clip, the distal hooks spaced apart from, and located proximal to, the distal clip attached to the respective distal arm.

2. The dressing aid of claim 1 wherein the at least two proximal arms and the at least two distal arms are metallic.

3. The dressing aid of claim 1 wherein the proximal and distal hooks are L-shaped.

4. The dressing aid of claim 1 wherein the proximal and distal hooks are comprised of an elastic material.

5. The dressing aid of claim 1 wherein each proximal arm comprises a proximal arm interior surface facing the other respective proximal arm and a proximal arm exterior surface opposite the interior surface, wherein each distal arm comprises a distal arm interior surface facing the other respective distal arm and a distal arm exterior surface opposite the interior surface and further wherein the proximal hooks are attached to the exterior surface of the proximal arms and the distal hooks are attached to the exterior surface of the distal arms.

6. The dressing aid of claim 1 wherein the main arm is in the shape of a bent cylinder.

7. The dressing aid of claim 6 wherein the proximal arms and the distal arms are in the shape of a bent cylinder, wherein the main arm comprises a diameter, and further wherein the proximal arm and distal arms have a smaller diameter as compared to the main arm diameter.

8. The dressing aid of claim 1 wherein the clips are alligator clips.

9. The dressing aid of claim 1 wherein the proximal arms and the distal arms are approximately the same length and shorter than the main arm.

10. A method of donning a leg garment on a human user having at least one leg and a foot located below the leg, the method comprising the steps of:

a) providing the dressing aid of claim 1;

b) positioning a leg garment below the foot;

c) attaching the clips to the leg garment; and d) grasping the main arm and moving the garment upwardly over the leg of the user.

11. The method of claim 10 wherein each proximal arm and distal arm is bent in multiple directions.

12. The method of claim 10 wherein the main arm is U-shaped.

13. The method of claim 10 wherein the user has limited mobility.

14. A method of donning a leg garment on a human user having at least one leg and a foot located below the leg, the method comprising the steps of:

a) providing the dressing aid of claim 1;

b) positioning a leg garment below the foot;

c) draping excess material of the leg garment over the hooks; and d) grasping the main arm and moving the leg garment upwardly over the leg of the user.

15. The method of claim 14 wherein each proximal arm and distal arm is bent in multiple directions.

16. The method of claim 14 wherein the main arm is U-shaped.

17. The method of claim 14 wherein the user has limited mobility.

* * * * *